United States Patent [19]

Sinke

[11] 4,071,328

[45] Jan. 31, 1978

[54] METHOD OF REMOVING SULFUR FROM COAL

[75] Inventor: Gerard C. Sinke, Midland, Mich.

[73] Assignee: The Dow Chemical Company, Midland, Mich.

[21] Appl. No.: 651,371

[22] Filed: Jan. 22, 1976

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 2,057,486 | 10/1936 | Higgins | 201/17 X |
| 2,726,148 | 12/1955 | McKinley et al. | 44/1 R |
| 3,214,346 | 10/1965 | Mason et al. | 201/17 X |
| 3,393,978 | 7/1968 | Murphy et al. | 201/17 X |
| 3,926,575 | 12/1975 | Meyers | 44/1 R |

*Primary Examiner*—Carl F. Dees

*Attorney, Agent, or Firm*—J. M. Kuszaj

[57] ABSTRACT

A process of reducing the total sulfur content of coal is disclosed. The process comprises hydrogenating the coal to remove at least a portion of the recoverable sulfur combined as pyritic sulfur. The hydrogenated coal is subsequently contacted with a sufficient amount of an aqueous inorganic acid solution to remove at least a portion of the remaining sulfur initially combined as pyritic sulfur.

16 Claims, No Drawings

METHOD OF REMOVING SULFUR FROM COAL

BACKGROUND OF THE INVENTION

This invention relates to the desulfurization of coal and more in particular to a process of reducing the pyritic sulfur content of coal.

The energy crisis has made inevitable an increasing use of high sulfur coal as fuel. At the same time, unexpected difficulty in scrubbing $SO_2$ from stack gases has spiraled projected costs of controlling air pollution. Furthermore, it has been estimated that the amount of sulfur oxide produced from the combustion of coal will increase from $26 \times 10^6$ metric tons annually in 1966 to $55 \times 10^6$ metric tons annually by 1990. As a result, there is increased interest in techniques for removing sulfur from coal prior to combustion.

Coal is generally classified in four groups: 1 anthracite, 2 bituminous, 3 sub-bituminous, and 4 lignite. The sulfur content of these coals is broadly divided into three classes; pyritic ($FeS_2$), organic sulfur molecularly bound to the coal matrix, and sulfate. The last named occurs only in weathered coal and can be essentially neglected when dealing with freshly mined coal. In a typical grade of coal, about half the sulfur is present as pyrite in simple mixture with other constituents; the rest is locked into organic molecules.

Many methods for removing the sulfur in coal prior to combustion have been devised. One method, described in *The Journal of Industrial and Engineering Chemistry,* 12, 1069 (1920), involves the treatment of coal at elevated temperatures and atmospheric pressure with hydrogen gas. During hydrogenation the pyritic sulfur is reported to form a species resistive to subsequent acid treatment. The process of U.S. Pat. No. 2,726,148 discloses a process of treating coal at both an elevated temperature and at an elevated pressure with hydrogen.

One disadvantage of these simple hydrogenation processes is that in most cases only about 50% by weight of the recoverable sulfur initially combined as pyritic sulfur in the coal can ultimately be removed. It is desirable that a process be developed to increase the amount of pyritic sulfur that can be removed from coal, thereby reducing the total sulfur content of the coal.

SUMMARY OF THE INVENTION

The present invention is a novel process of reducing the total sulfur content of coal. The process comprises hydrogenating the coal to remove at least a portion of the recoverable sulfur combined as pyritic sulfur. The hydrogenated coal is then contacted with a sufficient amount of an aqueous inorganic acid solution to remove at least a portion of the remaining sulfur initially combined as pyritic sulfur.

DESCRIPTION OF THE PREFERRED EMBODIMENT

In one embodiment of the present invention a coal selected from the group consisting of bituminous, anthracite, sub-bituminous, and lignite is crushed and sized to a suitable particle size. A particle size of less than about 100 U.S. Standard mesh is preferred. Preferably, the coal is then transferred to a reaction vessel capable of withstanding elevated temperatures and pressures. The reaction vessel is thereafter sealed and evacuated. A reaction vessel such as closed reaction bomb has been found satisfactory.

Hydrogen is introduced into the reaction vessel to react with at least a portion, and preferably substantially all, of the recoverable sulfur combined as pyritic sulfur in the coal. The hydrogen pressure within the reaction vessel can be any pressure above atmospheric pressure. However, the efficiency of desulfurization is increased when the hydrogen pressure is maintained at the preferred level of from about 200 to about 550 pounds per square inch gauge (psig).

The hydrogen may be mixed with inert gases such as nitrogen or argon. However, inclusion of other gases increases the time required for the reaction.

The reaction vessel, during pressurization, is heated by means of any suitable heating device, such as an electrical heater, furnace or the like. Sufficient heat is applied to the reaction vessel to increase the temperature of its contents to a temperature sufficient to remove at least part, and preferably substantially all, of the recoverable sulfur combined as pyritic sulfur. The temperature should preferably be sufficient to minimize loss of coal as volatiles within the reaction vessel and prevent excessive caking of the coal. It has been found that substantial desulfurization occurs when the temperature of the contents of the reaction vessel is from about 300° C to about 350° C, and more preferably from about 320° C to about 350° C.

The preferred temperature and pressure conditions of the hydrogenation reaction are maintained for a sufficient time to allow at least a portion, and preferably substantially all, of the recoverable sulfur combined as pyritic sulfur in the coal to be removed by reaction with the hydrogen within the reaction vessel to form a product consisting essentially of iron (II) sulfide (FeS) and hydrogen sulfide ($H_2S$). The course of the reaction may be followed by monitoring the gaseous stream containing the hydrogen sulfide ($H_2S$). When the concentration of the hydrogen sulfide ($H_2S$) drops to a predetermined level, the hydrogenation may be discontinued. The total time for the reaction of the coal may be adjusted to compensate for the effects of temperature, pressure, particle size, and cost. When the hydrogenation is carried out at the preferred temperature, pressures and particle size disclosed above, it has been determined that a reaction time of at least about 2 hours is preferred for at least a portion of the recoverable sulfur combined as pyritic sulfur to be removed. However, a reaction time of from about 2 hours to about 4 hours allows substantially all of the recoverable sulfur combined as pyritic sulfur to be removed.

The conditions of temperature and time under which the present invention may be practiced are interdependent. Generally, longer times allow lower reaction temperatures. However, certain considerations, as indicated above, indicate a preferable range for time and temperature under which substantially all of the recoverable sulfur combined as pyritic sulfur in the coal can be removed.

After the reaction vessel has been heated for a sufficient time for at least a portion, and substantially all of the recoverable sulfur combined as pyritic sulfur to be removed, the reaction vessel is allowed to gradually cool to about room temperature. Air cooling of the reaction vessel is preferred, although any other suitable means of gradual cooling such as step-wise reduction of the heating temperature may be employed.

When the reaction vessel has cooled to about room temperature, the hydrogen pressure within the reaction vessel is reduced to about atmospheric pressure. The hydrogenated coal is contacted with a sufficient amount of an aqueous inorganic acid solution to react with any iron (II) sulfide (FeS) formed during hydrogenation and thereby remove at least a portion, and preferably substantially all, of the remaining recoverable sulfur originally combined as pyritic sulfur, and now substantially entirely in the form of iron (II) sulfide (FeS). The contacting of the hydrogenated coal with an aqueous inorganic acid solution can be carried out in a number of ways including digesting the hydrogenated coal with the aqueous inorganic acid solution or by acid leaching or the like.

Strong aqueous inorganic acid solutions of HCl, $H_2SO_4$, $HNO_3$, HBr, HI, or HF may be employed in the present invention. However, HCl does not leave contaminated residue in the coal and is the preferred aqueous inorganic acid solution of the present invention. An aqueous inorganic acid concentration of from about 1 to about 3 Normal (N) gives satisfactory results.

The mixture of hydrogenated coal and aqueous inorganic acid solution is agitated and heated by any suitable means. The hydrogenated coal is contacted with the aqueous inorganic acid solution for a sufficient time to allow at least a portion, and preferably substantially all, of the iron (II) sulfide (FeS) to react with the acid. A time from about 0.5 to about 1 hour gives good results, and is preferred for such a reaction. The temperature range at which the contacting takes place may vary. A temperature range of from about 40° C to about 80° C gives satisfactory results.

After sufficient contact time, the hydrogenated-acid contacted coal product is separated from the inorganic acid solution by, for example, filtration, although other separation methods could be employed. Following separation, the hydrogenated-acid contacted coal product is treated to remove at least a portion, and preferably substantially all, of the water soluble reaction products (such as iron (II) chloride ($FeCl_2$)) and any excess inorganic acid. Washing the coal product with a solvent such as water has found to be a suitable means of treating the hydrogenated-acid contacted coal product.

The following examples illustrate the invention more specifically:

Bituminous coal samples from the Allison Mine of eastern Ohio were used in all of the following examples. The total sulfur content of the coal was 4.49 by weight as determined by the standard sulfur test of the American Society for Testing and Material ASTM Designation: D2492-68. The coal contained 2.20% by weight pyritic sulfur, 2.21% by weight organic sulfur, and 0.08% by weight sulfate.

EXAMPLE 1

Pieces of coal were crushed and sized to a particle size of less than about 100 mesh. A 20.2 gram sample of the crushed coal was transferred into a 1400 cubic centimeter reaction vessel, which was then pressurized with substantially only hydrogen gas to about 525 psig.

During pressurization, the reaction vessel was heated by an electric heater to increase the temperature of its contents to about 315° C. The temperature and pressure were maintained for 2 hours. After 2 hours, the reaction vessel was allowed to air cool to about room temperature over a period of about 16 hours. The pressure was then reduced to about one atmosphere. The hydrogenated coal was removed from the reaction vessel and weighed. 19.65 grams of residue and iron (II) sulfide (FeS) were recovered. A 5.00 g sample of the hydrogenated coal was transferred to a flask and contacted with an aqueous solution of 1 N HCl by digesting the hydrogenated coal with about 50 ml of the 1 N HCl solution at about 60° C for about two hours. The inside walls of the flask were occasionally washed down with water.

After about 2 hours, the resulting slurry was vacuum filtered, using a Number 42 Whatman filter paper and a Buckner funnel. The solid residue was collected on the filter paper and washed with water to remove any water soluble reaction products.

The filtrate was collected and analyzed for $Fe^{+2}$ by complexing the filtrate with 1,10-phenanthroline and subsequently collecting colorimetry readings using a Beckmann U.V spectrophotometer. The percentage of pyritic iron removed from the coal was calculated by subtracting the amount of iron soluble in the aqueous HCl solution before hydrogenation, from the amount of iron recovered from the filtrate after hydrogenation and acid contacting. This quantity was divided by the amount of iron initially present in the coal as determined by ASTM D2492-68. In all examples about 0.25% by weight of the initial coal was acid soluble iron, and about 1.92% by weight pyritic iron. In the present example about 87.0% by weight of pyritic iron was removed by the method of the present invention. The results and reaction conditions are shown in Table I.

The hydrogenated-acid contacted solid residue was analyzed for residual sulfur by either (a) combusting the residue in a Leco Sulfur Determinator furnace Model 532 and absorbing and titrating the resulting $SO_2$ and $SO_3$ vapors or (b) by heating the residue with Eschka mixtures as described in ASTM-D-271, dissolving the mixture in water, and determining sulfate ion in the solution with a Somersen-Klett colorimeter. The percentage by weight of pyritic sulfur removed was determined by standard calculation. In the present example about 97.8% of the pyritic sulfur was removed.

The discrepancy between the value of the pyritic iron and sulfur removed is thought to be partly due to the removal of some organic sulfur, and partly due to limitations in the accuracy of the testing procedures.

EXAMPLES 2–11

Additional samples of coal were treated substantially according to the basic method of Example 1. The hydrogenation temperature and pressure varied, but the hydrogenation reaction time was two hours in all cases. Table I sets forth the conditions and the significant pyritic sulfur removal obtained by the use of the method of the present invention.

As can be seen in column five of Table I, all samples showed a significant decrease in the total sulfur content of the coal after treatment by the present method.

Column six shows the percent by weight of pyritic sulfur removed by the present process. Within the preferred temperature range of 300° C to 350° C at least about 75 percent of the recoverable sulfur initially combined as pyritic sulfur was removed.

Examples 8 and 9 were treated substantially according to the basic method of Example 1, except that the coal was additionally analyzed for sulfur following hydrogenation, but before acid contacting. The results obtained after only hydrogenation are shown by an asterisk (*) in Table I. Treatment of Examples 8 and 9 by the present invention showed a surprising increase of 34% by weight and 41% by weight respectively in the amount of pyritic sulfur removed as compared to mere hydrogenation.

Examples 10 and 11 show greater than 100% pyritic sulfur removal. This is thought to be due to the removal of organic sulfur from the coal at elevated temperatures. The low pyritic iron value in Example 11 is thought to be due to decomposition of the coal at elevated temperature and to the formation of a tar residue resistive to acid contacting.

TABLE I

| Example | Reaction Conditions: Hydrogenation Temperature (° C) | Reaction Conditions: Hydrogenation Pressure (psig) | Sulfur Content (% by weight) of: Coal as Received | Coal after Treatment by Present Method | Pyritic Sulfur Removed (% by weight) | Pyritic Iron Removed (% by weight) |
|---|---|---|---|---|---|---|
| 1 | 315 | 525 | 4.49 | 2.40 | 97.80 | 87.00 |
| 2 | 242 | 415 | 4.49 | 3.90 | 28.00 | 21.00 |
| 3 | 263 | 420 | 4.49 | 3.60 | 44.30 | 54.40 |
| 4 | 275 | 455 | 4.49 | 3.20 | 63.00 | 68.00 |
| 5 | 279 | 455 | 4.49 | 3.00 | 72.70 | 90.30 |
| 6 | 293 | 400 | 4.49 | 3.80 | 72.00 | 78.00 |
| 7 | 310 | 490 | 4.49 | 2.89 | 80.00 | 82.00 |
| 8 | 325 | 490 | 4.49 | 2.88 | 78.00 (44.00)* | 86.00 |
| 9 | 330 | 480 | 4.49 | 2.83 | 82.00 (41.00)* | 92.00 |
| 10 | 400 | 600 | 4.49 | 2.20 | 122.00 | 72.40 |
| 11 | 438 | 645 | 4.49 | 2.70 | 109.20 | 1220 |

What is claimed is:

1. A process of reducing the total sulfur content of coal comprising:

hydrogenating the coal to convert at least a portion of the recoverable sulfur combined as pyritic sulfur to iron (II) sulfide;

contacting the hydrogenated coal with a sufficient amount of an aqueous hydrochloric acid solution to remove at least a portion of the sulfur combined as iron (II) sulfide.

2. The process of claim 1 wherein the coal is hydrogenated under a pressure of from about 200 to about 550 pounds per square inch gauge.

3. The process of claim 1 wherein the coal has a particle size of less than about 100 U.S. Standard Mesh.

4. The process of claim 1 wherein the coal is hydrogenated at a temperature of from about 300° to about 350° C.

5. The process of claim 4 wherein the coal is hydrogenated for at least about 2 hours.

6. The process of claim 4 wherein the coal is hydrogenated for from about 2 hours to about 4 hours.

7. The process of claim 1 wherein the coal is hydrogenated at a temperature of from about 320° C to about 350° C.

8. The process of claim 1 wherein the coal is hydrogenated for a sufficient time to convert at least a portion of the recoverable sulfur combined as pyritic sulfur to iron (II) sulfide.

9. The process of claim 1 wherein the contacting is carried out by digesting the hydrogenated coal with a sufficient amount of the aqueous hydrochloric acid solution to react with and thereby remove at least a portion of the sulfur present as iron (II) sulfide.

10. The process of claim 1 wherein the aqueous hydrochloric acid solution is one normal hydrochloric acid.

11. The process of claim 1 wherein the hydrogenated coal is contacted with the aqueous hydrochloric acid solution at a temperature of about 40° C to about 80° C.

12. The method of claim 1 wherein the coal is selected from the group consisting of bituminous, anthracite, sub-bituminous, and lignite.

13. A process of reducing the total sulfur content of coal comprising:

a. hydrogenating the coal under a pressure of from about 200 to about 550 pounds per square inch gauge at a temperature of from about 300° C to about 350° C for a sufficient time to convert at least a portion of the recoverable sulfur combined as pyritic sulfur to iron (II) sulfide;

b. contacting the hydrogenated coal at a temperature of from about 40° C to about 80° C with a sufficient amount of an aqueous hydrochloric acid solution to react with and thereby remove at least a portion of the sulfur combined as iron (II) sulfide.

14. The process of claim 13 wherein the aqueous hydrochloric acid solution is a one normal hydrochloric acid solution.

15. The process of claim 13 wherein the hydrogenation and contacting remove at least about 75 percent of the recoverable sulfur initially combined as pyritic sulfur.

16. The process of claim 13 wherein the hydrogenated coal is contacted with substantially only an aqueous hydrochloric acid solution.

* * * * *

UNITED STATES PATENT AND TRADEMARK OFFICE

CERTIFICATE OF CORRECTION

PATENT NO. : 4,071,328
DATED : January 31, 1978
INVENTOR(S) : Gerard C. Sinke

It is certified that error appears in the above-identified patent and that said Letters Patent are hereby corrected as shown below:

In Table I, Sulfur Content should be above Columns 5 and 6.

In Table I, example 11, delete "1220" and insert --12.20--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*